United States Patent [19]

Graf

[11] Patent Number: 4,893,380

[45] Date of Patent: Jan. 16, 1990

[54] CARD CLOTHING FOR FLATS OF A CARDING MACHINE

[75] Inventor: Ralph A. Graf, Freienbach, Switzerland

[73] Assignee: Gtsg & Cir. AG, Rapperswil, Switzerland

[21] Appl. No.: 174,099

[22] Filed: Mar. 28, 1988

[30] Foreign Application Priority Data

Dec. 27, 1987 [EP] European Pàt. Off. ..... 87119240.7

[51] Int. Cl.[4] ..... D01G 15/24

[52] U.S. Cl. ..... 19/114

[58] Field of Search ..... 19/113, 114

[56] References Cited

U.S. PATENT DOCUMENTS 3,737,953 6/1973 Bechtel ..... 19/113
4,513,480 4/1985 Bisquolm et al. ..... 19/113

FOREIGN PATENT DOCUMENTS 0240221 5/1965 Austria ..... 19/114
690266 5/1967 Belgium .
0144607 6/1985 European Pat. Off. .
3321236 12/1984 Fed. Rep. of Germany .
0860417 2/1961 United Kingdom ..... 19/113

*Primary Examiner*—Werner H. Schroeder
*Attorney, Agent, or Firm*—Ladas & Parry

[57] ABSTRACT

Each saw tooth wire strip is provided with a plurality of angular bends forming a plurality of strip sections. The strip sections located at the leading and the trailing end of the wire strip extend parallel to the direction of fibre flow. The intermediate strip sections extend inclined thereto. This allows a setting of a higher number of teeth in the card clothing. Also, a highly improved performance of the opening of neps as well as paralleliz-ing of the fibres is achieved. The wire stips are threaded onto an elongated carrier member and are locked thereonto by means of a locking member in a prestressed state. It is, therefore, not possible that individual wire strips can be torn off by any forces acting thereupon leading to damages of the machine.

4 Claims, 1 Drawing Sheet

CARD CLOTHING FOR FLATS OF A CARDING MACHINE

BACKGROUND OF THE INVENTION

1. Field of the Invention

The present invention relates to a card clothing for flats of a carding machine, which card clothing includes a plurality of mutually abutting saw tooth wire strips. Carding machines include as main working elements a rotating main carding drum provided with a saw tooth wire clothing in form of a saw tooth wire strip helically wound therearound and flats provided with a card clothing and located along a part of the circumference of the carding drum. One design of clothing of the flats includes a plurality of saw tooth wire strips. These cooperate with the clothing of the carding drum to produce a fleece free of neps and having parallelized fibres.

2. Description of the Prior Art

The DE-AS No. 21 45 459, corresponding to U.S. Pat. No. 3,737,953, discloses a card clothing for flats of a carding machine having a plurality of saw tooth wire strips. These saw tooth wire strips are embedded in a plastic material by means of which they are mounted onto the flats. The strips are, furthermore, bent at one location or extend, alternatively, curvilinear with the object to arrive at a higher number of teeth per working square unit and to improve the quality of the fleece produced.

It has been found that in operation individual saw tooth wire strips got torn out of the plastic material substrate leading to damages of the machine. The reason of this drawback is among others that due to the angular or bent shape of the individual saw tooth wire strips a lateral force acts onto same which can exceed the arresting force of the plastic material such that individual wire strips can be torn out of the plastic substrate. It also has been found that this known design was somewhat deficient regarding the opening, cleaning of fibres or elimination of trash, resp. of neps contained in the web.

SUMMARY OF THE INVENTION

It is, therefore, a general object of the present invention to provide a card clothing for flats of a carding machine which positively eliminates the danger of individual saw tooth wire strips being torn away from the flat and which leads to an improved fleece.

A further object of the present invention is to provide a card clothing for the flats of a carding machine in which each saw tooth strip comprises at least two angular bends forming a plurality of wire strip sections of which at least one extends inclined relative to the direction of fibres flow, and in which the saw tooth wire strips are clampingly supported on an elongated carrier member in a lateral mutually prestressed manner.

BRIEF DESCRIPTION OF THE DRAWING

The invention will be better understood and objects other than those set forth above, will become aparent when consideration is given to the following detailed description thereof. Such description makes reference to the annexed drawing, wherein.

DESCRIPTION OF THE PREFERRED EMBODIMENTS

Figure 1:
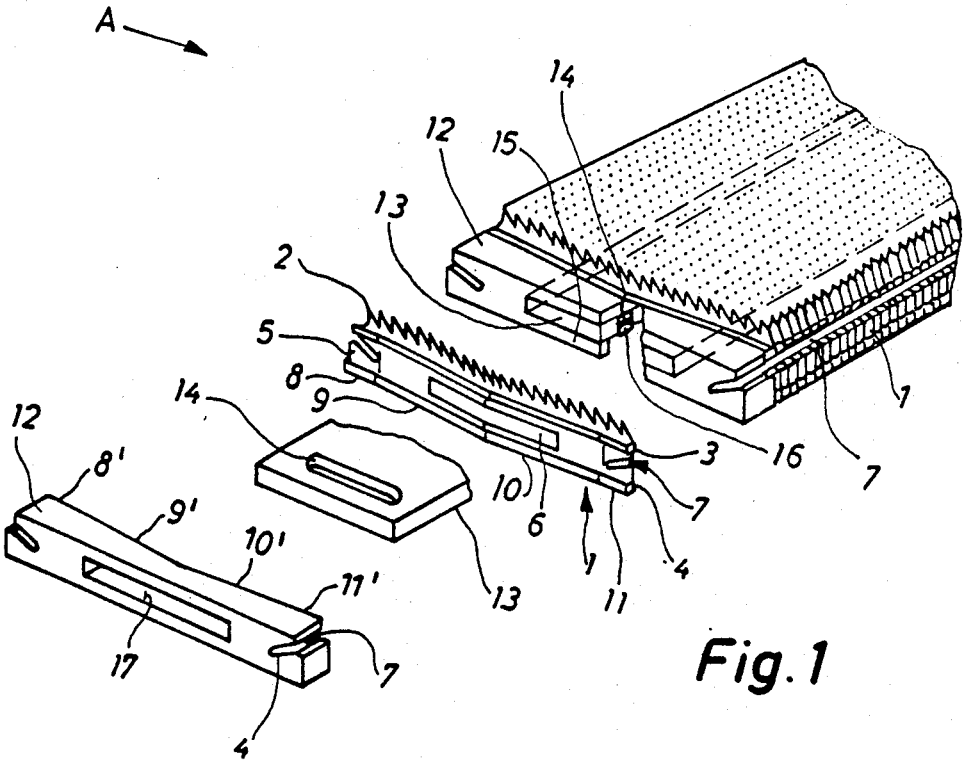
FIG. 1 illustrates in a partially exploded view an embodiment of the present invention.

FIG. 1 illustrates a card clothing comprising a plurality of saw tooth wire strips 1 having a number of bends such that each saw tooth wire strip 1 is divided into several sections identified in FIG. 1 by the reference numerals 8,9,10,11.

Figures 2, 3, 4, 5, 6, 7:
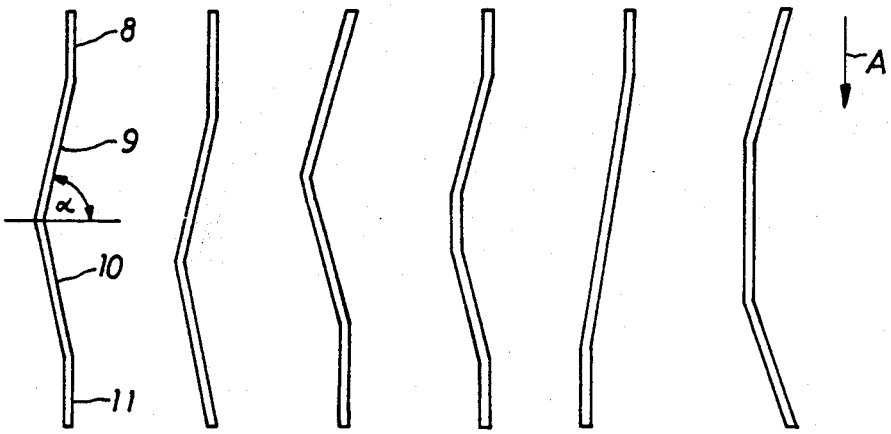
FIG. 2–7 illustrate top views of individual saw tooth wire strips embodying the present invention.

FIG. 2 illustrates a top view of the same embodiment of the inventive saw tooth wire strip. The direction of the fibre flow is indicated in all figures by the arrow "A".

The portion 8 of the saw tooth wire strip is located at its leading end and extends parallel to the direction of the fibre flow "A". The strip 1 is now angularly bent such that the next section 9 extends inclined relative to the direction of the fibre flow "A". The angular of the inclination identified by $\alpha$ in FIG. 2 may be in the range from abount 65° to about 89°.

This section 9 is followed by a further section 10 which is also inclined relative to the direction of the fibre flow "A", but in an opposite sense.

A final section 11 at the trailing end of the saw tooth wire strip 1 extends again parallel to the direction of the fibre flow "A".

In operation the incoming fibres will initially be engaged by the teeth of the leading section 8 of the saw tooth wire strip 1 extending parallel to the direction of fibre flow such that the fibres are engaged by the sharpest working or treating area of the clothing. This produces an excellent opening or eliminating, resolving of the neps of the fibres. After passing this initial treating zone the fibres will be engaged by the teeth of the first inclined strip section 9. Due to the inclination of the teeth relative to the direction of fibre flow an excellent parallelizing of the fibres is arrived at. The strip section 9 is followed by the oppositely inclined strip section 10 improved the parallelizing still further. Finally, the trailing and parallel section 11 of the clothing adds further to the resolving of neps or neplike entanglements.

Due to the inclined orientation of the two intermediate sections 9 and 10 it is conclusively possible to chose a larger range of alternative settings of the teeth of the card clothing.

FIGS. 3–7 illustrate further embodiments or possibilities of practicing the present invention. The various shapes can be installed depending e.g. on certain particularities of the fibres being treated.

It is now obvious that due to the inclined oriented sections 9 and 10 of the saw tooth wire strip a lateral force will be exerted onto a mounting means by which the strips are mounted onto their carrier. As mentioned above, a bonding by means of a bonding agent or a setting into a substrate of a plastic material leads to individual wire strips being torn off.

Thus, the strips of the present invention are mounted such that above danger is eliminated.

FIG. 1 illustrates among other details one single saw tooth wire strip 1 including a row of teeth 2.

The strip 1 is of a twin-foot design having an upper foot 3 and a lower foot 4 including a web portion 5 extending therebetween. The web portion 5 is provided with a rectangular opening 6. At the two far ends of the strip 1 a slanted slot 7 is provided. This embodiment of the saw tooth wire strip 1 is angularly bent in accordance with the invention and this particular embodiment of the orientation of the various sections of the strip is specifically clearly illustrated in the top view of FIG. 2.

As illustrated in FIG. 1 a plurality of saw tooth wire strips 1 is threaded onto an elongated carrier member 13 which extends through the individual openings 6 of the wire strips 1. The embodiment incorporates a carrier member 13 in form of a flat profile section. Obviously, other profiles may be used too, such as e.g. U-profiles, T-profiles, I-profiles, whereby the corresponding opening 6 in the saw tooth wire strips 1 may also have accordingly designed shapes.

The individual slots 7 of the thus formed wire strip package unite to form a longitudinally extending slot. This slot will receive the known elongated clips by means of which the wire strip package is mounted to the flat as is common practice.

The elongated carrier member 13 includes at its end section a laterally thereof extending opening. This opening 14 is to cooperate with a block shaped locking member 12. This locking member is provided with respective slots 7 for receiving above mentioned clips, and with an opening 17 corresponding in shape and location to the rectangular openings 6 of the wire strips 1.

The opposite end of the elongated carrier member 13 may have a block shaped abutment integrally mounted thereto and operative to abuttingly contact the last wire strip of the entire package, or, alternatively, may be provided with a further opening 14 for lockingly receiving a further block-shaped locking member 12.

In order to lock the block-like locking member 12 onto the carrier 13, the bottom portion of the locking member 12, i.e. the portion extending below its opening 17 is slot such to form two bars 15 and 16. After the locking member 12 has been slid onto the carrier member 13, bar 16 is deformed upwards such to engage into the opening 14 such that the locking member 12 is secured to the carrier member 13. Quite obviously, a variety of different securing means be applied.

This particularly illustrated securing means corresponds to that which is disclosed in the CH-PS 655 521 of the same applicant.

After the locking member 12 has been slid onto the carrier member 13 but before deforming its bar 16 into opening 14 a pressure is applied onto the locking member 12 such to have a prestressing force acting onto all saw tooth wire strips. The locking of the locking member 12 onto the carrier member 13 proceeds accordingly at this prestressed condition of the wire strips 1 such that after the bar 16 has been lockingly deformed into the opening 14 the saw tooth wire strips 1 are in a state of a permanent prestress on the carrier member 13.

It is now obvious that laterally directed force components acting onto the individual saw tooth wire strips 1 can in no way give rise to the danger of individual wire strips getting torn out of their anchoring and thus damage the machine. Also, due to the illustrated angulated extent of the wire strips a vastly improved operational behaviour regarding the opening of neps as well as the parallelizing of the fibres treated is achieved.

While there are shown and described present preferred embodiments of the invention, it is to be distinctly understood that the invention is not limited thereto, but may be otherwise variously embodied and practiced within the scope of the following claims.

I claim:

1. A card clothing for flats of a carding machine, said card clothing includes a plurality of mutually abutting saw tooth wire strips, each saw tooth wire strip comprising at least two angularly bent wire strip sections that extend inclined relative to the direction of fibre flow and at least one wire strip section that extends parallel relative to the direction of the fibre flow, and in which the saw tooth wire strips are clampingly supported on an elongated carrier member in a lateral mutually prestressed manner.

2. The card clothing according to claim 1, wherein two wire strip sections extend inclined relative to the direction of the fibre flow and two wire strip sections extend parallel relative to the direction of the fibre flow.

3. The card clothing of claim 2, wherein the two inclined extending wire strip sections are inclined oppositely to each other relative to the direction of fibre flow and the two parallel extending wire strip sections are located at leading and trailing ends of the saw tooth wire strip.

4. The card clothing of claim 1, in which the saw tooth wire strips are threaded onto the carrier member in a laterally abutting prestressed arrangement, and in which there is provided at least one locking member mounted to the carrier member in a state of exerting a permanent lateral stressing force onto the saw tooth strips.

* * * * *

UNITED STATES PATENT AND TRADEMARK OFFICE

CERTIFICATE OF CORRECTION

PATENT NO. : 4,893,380

DATED : January 16, 1990

INVENTOR(S) : Ralph Armin GRAF

It is certified that error appears in the above-identified patent and that said Letters Patent is hereby corrected as shown below:

On the title page, Item [73] Assignee:

change "Gtsg & Cir." to -- Graf & Cie--.

Signed and Sealed this

Twentieth Day of August, 1991

*Attest:*

HARRY F. MANBECK, JR.

*Attesting Officer*

*Commissioner of Patents and Trademarks*